United States Patent [19]

Banaska

[11] Patent Number: 5,039,934

[45] Date of Patent: Aug. 13, 1991

[54] CONTROL FOR VOLTAGE/CURRENT SOURCE WITH CURRENT/VOLTAGE LIMITING

[75] Inventor: John G. Banaska, Brunswick, Ohio

[73] Assignee: Keithley Instruments, Inc., Cleveland, Ohio

[21] Appl. No.: 527,018

[22] Filed: May 22, 1990

[51] Int. Cl.[5] ..... G05F 1/569

[52] U.S. Cl. ..... 323/268; 323/276; 323/277; 323/285; 361/79

[58] Field of Search ..... 323/246, 268, 274, 275, 323/276, 277, 285; 361/79, 86, 87

[56] References Cited

U.S. PATENT DOCUMENTS

| | | | |
|---|---|---|---|
| 3,697,862 | 10/1972 | Taylor | 323/268 |
| 4,004,155 | 1/1977 | Nercessian | 307/52 |
| 4,012,685 | 3/1977 | Nercessian | 307/53 |
| 4,268,790 | 5/1981 | Nercessian | 323/268 |
| 4,599,556 | 7/1986 | Lanz | 361/82 |
| 4,618,813 | 10/1986 | Vesce et al. | 323/268 |
| 4,684,876 | 8/1987 | Creel | 323/268 |

*Primary Examiner*—Peter S. Wong

*Attorney, Agent, or Firm*—Pearne, Gordon, McCoy & Granger

[57] ABSTRACT

An apparatus capable of acting as a current-limited voltage source or a voltage-limited current source is disclosed. The output of the apparatus is provided by a differential amplifier. The current and voltage outputs are compared to positive and negative current and voltage limits. Depending on whether the apparatus is in the voltage mode or the current mode, the inverting input of the differential amplifier is clamped to the appropriate voltage or current comparison signal, respectively, to provide an error signal to the differential amplifier. This clamping is current limited so that if the output current limits are exceeded while in the voltage source mode, a clamp to one of the current comparison signals occurs and dominates the voltage clamp. Similarly, if the output voltage limits are exceeded while in the current source mode, a clamp to one of the voltage comparison signals occurs and dominates the current clamp. To enable a voltage or current source limit to be set at zero, the opposite polarity limit is offset slightly to avoid contention should it also be set near zero.

7 Claims, 1 Drawing Sheet

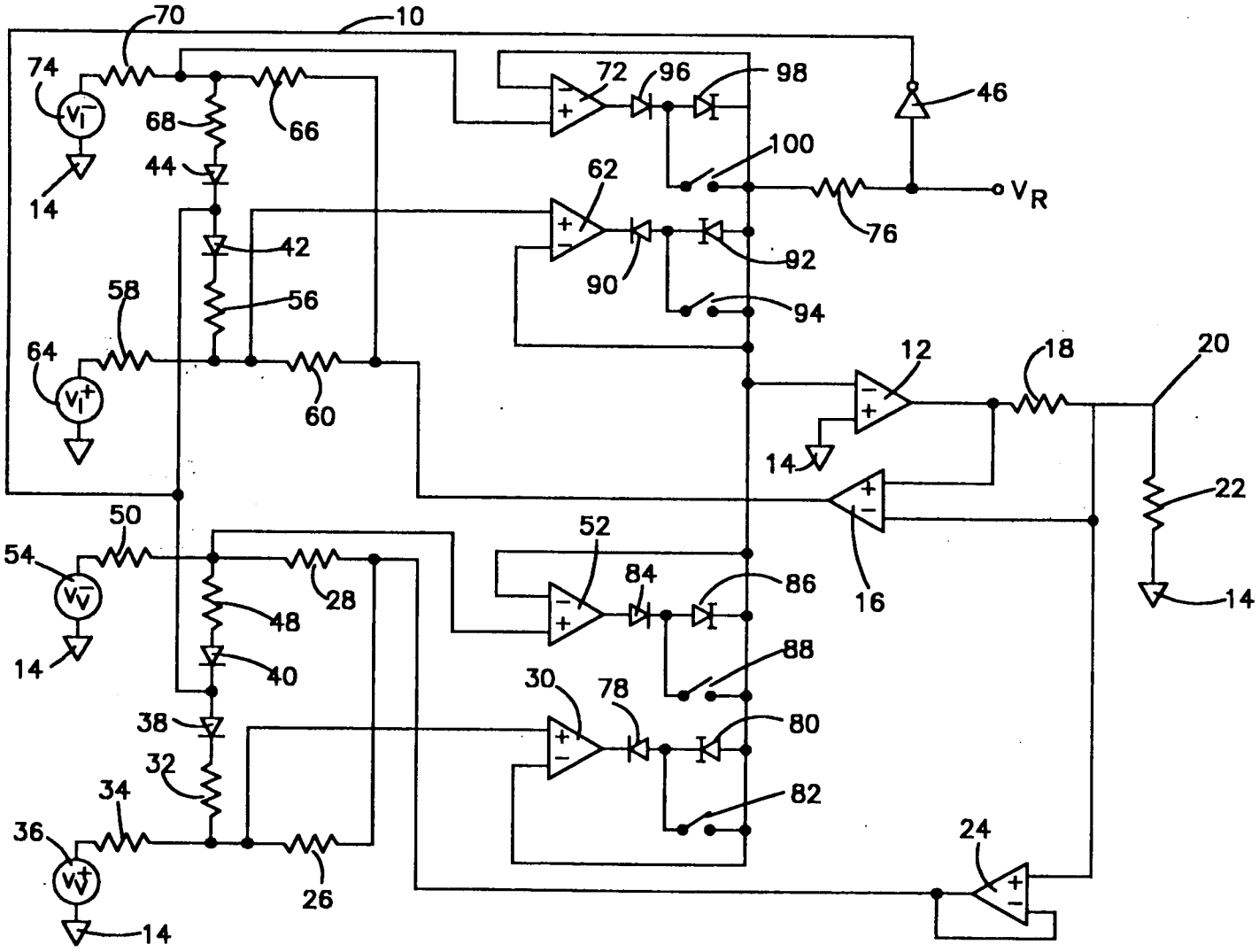
20
22
14
18
12
16
24
46
$V_R$
76
98
100
92
94
86
88
80
82
96
72
62
90
84
52
78
30
10
66
42
56
60
28
48
40
26
68
44
38
32
70
58
50
34
74
64
54
36

CONTROL FOR VOLTAGE/CURRENT SOURCE WITH CURRENT/VOLTAGE LIMITING

BACKGROUND OF THE INVENTION

The present invention relates to a control circuit for a combination voltage and current source that is current limited in the voltage source mode and voltage limited in the current source mode.

In various applications, it is often required to have a voltage source operating at given voltage unless certain current limits are exceeded. Such voltage sources, for example, allow the testing of various circuits and components while minimizing the chance of damage to either the item under test or the voltage source.

Similarly, it is often required to have a current source operating at a given current unless certain voltage limits are exceeded.

Rather than having both a voltage source and a current source, it is useful to have one apparatus that can act as a current-limited voltage source or a voltage-limited current source.

However, such an apparatus must be able to control all four possible quadrants of operation. It must be able to handle positive or negative voltage in combination with positive or negative current. Voltage and current of opposite polarity can occur if the device connected to the apparatus can also act as a source of current or voltage. This may be no more than, for example, a capacitive load connected to the apparatus when the value of the voltage source is lowered, the capacitor seeking to discharge its then excess charge through the apparatus.

In addition, in many applications it is desirable to utilize a zero voltage source or a zero current source. This can effectively collapse the four quadrants into to what can easily become an unstable configuration. Near zero, the control circuitry may be unable to determine the correct polarity of signals for proper control.

SUMMARY OF THE INVENTION

The present invention provides an electrical apparatus capable of acting as a current-limited voltage source or a voltage-limited current source.

The apparatus includes a differential amplifier having an inverting input and an output, and a current sensing means adapted to sense current from the output.

Also included is a positive current reference, a first current comparator adapted to compare the output current and the positive current reference and to provide a first signal indicative thereof, a first clamp responsive to the first signal and connected to the inverting input, a negative current reference, a second current comparator adapted to compare the output current and the negative current reference and provide a second signal indicative thereof, and a second clamp responsive to the second signal and connected to the inverting input.

In addition, the apparatus includes a voltage sensing means adapted to sense voltage at the output.

Also included is a positive voltage reference, a first voltage comparator adapted to compare the output voltage and the positive voltage reference and provide a third signal indicative thereof, a third clamp responsive to the third signal and connected to the inverting input, a negative voltage reference, a second voltage comparator adapted to compare the output voltage and the negative voltage reference and provide a fourth signal indicative thereof, and a fourth clamp responsive to the fourth signal and connected to the inverting input.

When the apparatus is acting as a positive voltage source, the third clamp clamps the inverting input to the third signal except that if the output current exceeds either the positive or negative reference current the first or second clamp, respectively, will dominantly clamp the inverting input to the first or second signal, respectively.

When the apparatus is acting as a negative voltage source, the fourth clamp clamps the inverting input to the fourth signal except that if the output current exceeds either the positive or negative reference current the first or second clamp, respectively, will dominantly clamp the inverting input to the first or second signal, respectively.

When the apparatus is acting as a positive current source, the first clamp clamps the inverting input to the first signal except that if the output voltage exceeds either the positive or negative reference voltage the third or fourth clamp, respectively, will dominantly clamp the inverting input to the third or fourth signal, respectively.

When the apparatus is acting as a negative current source, the second clamp clamps the inverting input to the second signal except that if the output voltage exceeds either the positive or negative reference voltage the third or fourth clamp, respectively, will dominantly clamp the inverting input to the third or fourth signal, respectively.

In this way the apparatus is able to operate in any of the four current/voltage quadrants. Control of the output is maintained irrespective of the characteristics of the load connected to the apparatus.

In the preferred embodiment, the second and fourth signals are offset positively when the apparatus is acting as a positive voltage source or a positive current source, and the first and third signals are offset negatively when the apparatus is acting as a negative voltage source or a negative current source.

Biasing the signals in this way makes it possible to set the current to zero when the apparatus is acting as a current source, or the voltage to zero when the apparatus is acting as a voltage source.

BRIEF DESCRIPTION OF THE DRAWING

The FIGURE is a schematic diagram of an apparatus according to the invention.

DESCRIPTION OF THE PREFERRED EMBODIMENT

Referring to the FIGURE, an apparatus 10 according to the invention is shown.

The noninverting input of a differential amplifier 12 is connected to a common tie 14. The output of the amplifier 12 is connected to the noninverting input of a differential amplifier 16 and to the first terminal of a current-sensing resistor 18. The second terminal of the resistor 18 is connected to the output terminal 20 of the apparatus 10, to the inverting input of the amplifier 16, and to the noninverting input of a differential amplifier 24.

The output terminal 20 is connected to the first terminal of a load 22. The second terminal of the load 22 is connected to the common tie 14.

The output of the amplifier 24 is connected to its inverting input, to the first terminal of a resistor 26 and to the first terminal of a resistor 28. The second terminal of the resistor 28 is connected to the noninverting input of a differential amplifier 30, to the first terminal of a resistor 32, and to the first terminal of a resistor 34.

The second terminal of the resistor 34 is connected to the positive terminal of an adjustable voltage source 36. The negative terminal of the voltage source 36 is connected to the common tie 14.

The second terminal of the resistor 32 is connected to the cathode of a diode 38. The anode of the diode 38 is connected to the cathode of a diode 40, to the anode of a diode 42, to the cathode of a diode 44, and to the output of an inverter 46.

The anode of the diode 40 is connected to the first terminal of a resistor 48. The second terminal of the resistor 48 is connected to the second terminal of the resistor 28, the first terminal of a resistor 50, and the noninverting input of a differential amplifier 52. The second terminal of the resistor 50 is connected to the negative terminal of an adjustable voltage source 54. The positive terminal of the voltage source 54 is connected to the common tie 14.

The cathode of the diode 42 is connected to the first terminal of a resistor 56. The second terminal of the resistor 56 is connected to the first terminal of the resistor 58, the first terminal of a resistor 60, and the noninverting input of a differential amplifier 62.

The second terminal of the resistor 58 is connected to the positive terminal of an adjustable voltage source 64. The negative terminal of the voltage source 64 is connected to the common tie 14.

The second terminal of the resistor 60 is connected to the output of the amplifier 16 and to the first terminal of a resistor 66. The second terminal of the resistor 66 is connected to the first terminal of a resistor 68, the first terminal of a resistor 70, and the noninverting input of a differential amplifier 72.

The differential amplifiers 12, 16, 24, 30, 52, 62, 72 may be, for example, one or more operational amplifiers.

The second terminal of the resistor 68 is connected to the anode of the diode 44. The second terminal of the resistor 70 is connected to the negative terminal of an adjustable voltage source 74. The positive terminal of the voltage source 74 is connected to the common tie 14.

A polarity reference voltage $V_R$ is connected to the input of the inverter 46 and to the first terminal of a resistor 76.

The output of the amplifier 30 is connected to the cathode of a diode 78. The anode of the diode 78 is connected to the cathode of a current regulator diode 80 and to the first terminal of a switch 82.

The output of the amplifier 52 is connected to the anode of a diode 84. The cathode of the diode 84 is connected to the anode of a current regulator diode 86 and to the first terminal of a switch 88.

The output of the amplifier 62 is connected to the cathode of a diode 90. The anode of the diode 90 is connected to the cathode of a current regulator diode 92 and to the first terminal of a switch 94.

The output of the amplifier 72 is connected to the anode of a diode 96. The cathode of the diode 96 is connected to the anode of a current regulator diode 98 and to the first terminal of a switch 100.

The current regulator diodes 80, 86, 92, 98 may be, for example, Siliconix CR430 current regulator diodes.

The inverting input of the amplifier 12 is connected to the inverting input of the amplifier 30, the inverting input of the amplifier 52, the inverting input of the amplifier 62, the inverting input of the amplifier 72, the second terminal of the resistor 76, the anode of the current regulator diode 80, the second terminal of the switch, 82, the cathode of the current regulator diode 86, the second terminal of the switch 88, the anode of the current regulator diode 92, the second terminal of the switch 94, the cathode of the current regulator diode 98, and the second terminal of the switch 100.

In operation, the amplifier 12 provides voltage and current to the load 22.

Current to the load 22 passes through the resistor 18. This produces a voltage across the inputs of the amplifier 16. The output of the amplifier 16 is a voltage, $V_{IO}$, that is therefore representative of the current to the load 22. The combination of the resistor 18 and the amplifier 16 thus acts as a current sensor for the output of the apparatus 10.

The voltage at the output terminal 20, $V_O$, is applied to the noninverting input of the amplifier 24. Because the output of the amplifier 24 is fed back to its inverting input, the output of the amplifier 24 is simply $V_O$. The amplifier 24 serves as a buffer between the output terminal 20 and the output of the amplifier 24. The amplifier 24 acts as a voltage sensor for the output of the apparatus 10.

The output of the amplifier 24 is applied to the voltage-dividing network of the resistors 26, 34 and to the voltage-dividing network of the resistors 28, 50.

The voltage, $V_V+$, from the voltage source 36 is applied to the other end of the voltage-dividing network of the resistors 26, 34. This serves to compare $V_O$ to $V_V+$. If, for example, the resistors 26, 34 are equal, a negative signal will be applied to the noninverting input of the amplifier 30 if $V_O$ is less than $-V_V+$ (except as described below).

If the voltage at the noninverting input of the amplifier 30 is negative, the diode 78 will conduct and provide an error signal to the inverting input of the amplifier 12 either through the current regulator diode 80 or, if closed, the switch 82. Because in this case the output of the amplifier 30 is fed back to its inverting input, the amplifier 30 will attempt to clamp the error signal to the signal from the network of the resistors 26, 34.

The error signal to the amplifier 12 will keep $V_O$ from going any further negative than $-V_V+$. The voltage, $-V_V+$, is thus the negative voltage limit on $V_O$.

On the other hand, if the voltage at the noninverting input of the amplifier 30 is positive, the diode 78 will block any output from the amplifier 30.

Similarly, the voltage, $V_V-$, from the voltage source 54 is applied to the other end of the voltage-dividing network of the resistors 28, 50. This serves to compare $V_O$ to $V_V-$. If, for example, the resistors 28, 50 are equal, a positive signal will be applied to the noninverting input of the amplifier 52 if $V_O$ is greater than $-V_V+$ (except as described below).

If the voltage at the noninverting input of the amplifier 52 is positive, the diode 84 will conduct and provide an error signal to the inverting input of the amplifier 12 either through the current regulator diode 86 or, if closed, the switch 88. Because in this case the output of the amplifier 52 is fed back to its inverting input, the amplifier 52 will attempt to clamp the error signal to the signal from the network of the resistors 28, 50.

The error signal to the amplifier 12 will keep $V_O$ from going any further positive than $-V_V^-$. The voltage, $-V_V^-$, is thus the positive voltage limit on $V_O$.

On the other hand, if the voltage at the noninverting input of the amplifier 52 is positive, the diode 84 will block any output from the amplifier 52.

In the same way, the voltage, $V_{IO}$, (which is representative of the current to the load 22) is compared to the voltage, $V_I^+$, of the voltage source 64 and the voltage, $V_I^-$, of the voltage source 74. If, for example, the amplifier 16 has unity gain, the amplifier 62 will attempt to clamp the error signal to the signal from the voltage-dividing network of the resistors 58, 60 if $V_{IO}$ is less than $-V_I^+$. This corresponds to limiting the current to the load 22 to less than a negative current, $-V_I^+/R$, where R is the resistance of the resistor 18.

Similarly, the amplifier 72 will attempt to clamp the error signal to the signal from the voltage-dividing network of the resistors 66, 70 if $V_{IO}$ is greater than $-V_I^-$. This corresponds to limiting the current to the load 22 to less than a positive current, $-V_I^-/R$.

To insure that the output of the apparatus 10 is operating at at least one of the voltage or current limits ($-V_V^+$, $-V_V^-$, $-V_I^+/R$, or $-V_I^-/R$), a slight bias voltage is applied to the error signal at the inverting input of the amplifier 12 by the polarity reference signal $V_R$. If $V_R$ is negative, the output of the apparatus 10 will, in general, be at one of the positive limits, $-V_V^-$ or $-V_I^+/R$. If $V_R$ is positive, the output of the apparatus 10 will, in general, be at one of the negative limits, $-V_V^+$ or $-V_I^+/R$. As a result, the polarity of $V_R$ determines the nominal output polarity of the apparatus 10.

The switches 82, 88, 94, 100 determine whether the current limits or the voltage limits will dominate in cases of contention.

If the apparatus 10 is to operate as a current-limiting voltage source, the switches 94, 100 are closed and the switches 82, 88 are open. Then, as long as the current output of the apparatus 10 is less than the limits, $-V_I^+/R$ or $-V_I^-/R$, either the amplifier 30 or the amplifier 52 will provide the error signal to the amplifier 12 through the current regulator diode 80 or the current regulator diode 86, respectively. However, if the currents, $-V_I^+/R$ or $-V_I^-/R$, are exceeded, the amplifier 62 or the amplifier 72, respectively, will provide an error signal to the amplifier 12 directly through the switch 94 or the switch 100, respectively. Because the voltage error signals are limited by the current regulator diodes 80, 86, the current error signals will dominate.

Similarly, if the apparatus 10 is to operate as a voltage-limiting current source, the switches 94, 100 are open and the switches 82, 88 are closed. Then, as long as the voltage output of the apparatus 10 is less than the limits, $-V_V^+$ or $-V_V^-$, either the amplifier 62 or the amplifier 72 will provide the error signal to the amplifier 12 through the current regulator diode 92 or the current regulator diode 98, respectively. However, if the voltages, $-V_V^+$ or $-V_V^-$, are exceeded, the amplifier 30 or the amplifier 52, respectively, will provide an error signal to the amplifier 12 directly through the switch 82 or the switch 88, respectively. Because the current error signals are limited by the current regulator diodes 92, 98, the voltage error signals will dominate.

The polarity reference voltage, $V_R$, is also inverted and applied to the diodes 38, 40, 42, 44. This has the effect of slightly offsetting the signals to the noninverting inputs of amplifiers 30, 62 positively when $V_R$ is negative and of slightly offsetting the signals to the noninverting inputs of the amplifiers 52, 72 negatively when $V_R$ is positive.

This allows the voltage sources 54, 70 to be set to zero, if desired, when the apparatus 10 is acting as a positive source and the voltage sources 36, 64 to be set to zero, if desired, when the apparatus 10 is acting as a negative source.

Without this bias, the non-ideal nature of the components, particularly offset in the amplifiers, could result in both the amplifier 62 and the amplifier 72 or both the amplifier 30 and the amplifier 52 trying to control the amplifier 12, resulting in a loss of control of the output of the apparatus 10.

The apparatus 10 is able to operate in any of the four current/voltage quadrants. Control of the output of the apparatus is maintained irrespective of the characteristics of the load 12 connected to the apparatus 10, or how the voltage sources 36, 50, 64, 74 (limits) are varied during the operation of the apparatus 10. In addition, the apparatus may be operated as a zero voltage source or a zero current source.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. An electrical apparatus capable of acting as a current-limited voltage source or a voltage-limited current source, said apparatus comprising:

a differential amplifier having an inverting input and an output;

a current sensing means adapted to sense current from said output;

a positive current reference;

a first current comparator adapted to compare said output current and said positive current reference and to provide a first signal indicative thereof;

a first clamp responsive to said first signal and connected to said inverting input;

a negative current reference;

a second current comparator adapted to compare said output current and said negative current reference and provide a second signal indicative thereof;

a second clamp responsive to said second signal and connected to said inverting input;

a voltage sensing means adapted to sense voltage at said output;

a positive voltage reference;

a first voltage comparator adapted to compare said output voltage and said positive voltage reference and provide a third signal indicative thereof;

a third clamp responsive to said third signal and connected to said inverting input;

a negative voltage reference;

a second voltage comparator adapted to compare said output voltage and said negative voltage reference and provide a fourth signal indicative thereof; and a fourth clamp responsive to said fourth signal and connected to said inverting input, wherein when said apparatus is acting as a positive voltage source said third clamp clamps said inverting input to said third signal except that if said output current exceeds either said positive or negative reference current said first or second clamp, respectively, will dominantly clamp said inverting input to said first or second signal, respectively, wherein when said apparatus is acting as a negative voltage source said fourth clamp clamps said inverting input to said fourth signal except that if said output current exceeds either said positive or negative reference current said first or second clamp, respectively, will dominantly clamp said inverting input to said first or second signal, respectively, wherein when said apparatus is acting as a positive current source said first clamp clamps said inverting input to said first signal except that if said output voltage exceeds either said positive or negative reference voltage said third or fourth clamp, respectively, will dominantly clamp said inverting input to said third or fourth signal, respectively, and wherein when said apparatus is acting as a negative current source said second clamp clamps said inverting input to said second signal except that if said output voltage exceeds either said positive or negative reference voltage said third or fourth clamp, respectively, will dominantly clamp said inverting input to said third or fourth signal, respectively.

2. An apparatus according to claim 1, wherein a negative bias voltage is applied to said inverting input to cause said apparatus to act as either said positive current source or said positive voltage source, and a positive bias voltage is applied to said inverting input to cause said apparatus to act as either said negative current source or said negative voltage source.

3. An apparatus according to claim 1, wherein said clamps have a selectable normal output and a selectable current-limited output, said normal outputs of said first and second clamps and said current-limited outputs of said third and fourth clamps being selected when said apparatus is acting as said voltage source and said current-limited outputs of said first and second clamps and said normal outputs of said third and fourth clamps being selected when said apparatus is acting as said current source.

4. An apparatus according to claim 3, wherein said first clamp clamps in response to said first signal being positive, said second clamp clamps in response to said second signal being negative, said third clamp clamps in response to said third signal being positive, and said fourth clamp clamps in response to said fourth signal being negative.

5. An apparatus according to claim 4, wherein said second and fourth signals are offset positively when said apparatus is acting as said positive voltage source or said positive current source, and said first and third signals are offset negatively when said apparatus is acting as said negative voltage source or said negative current source.

6. A method for controlling an electrical apparatus capable of acting as a current-limited voltage source or a voltage-limited current source, said apparatus having a differential amplifier having an inverting input and an output, said method comprising:

comparing the current from said output to a positive current reference to provide a first difference signal;

comparing the current from said output to a negative current reference to provide a second difference signal;

comparing the voltage at said output to a positive voltage reference to provide a third difference signal;

comparing the voltage at said output to a negative voltage reference to provide a fourth difference signal;

if said apparatus is acting as a positive or negative voltage source, clamping said inverting input to said third or fourth difference signal, respectively, and if the output current exceeds either said positive current reference or said negative current reference, dominantly clamping said inverting input to said first or second difference signal, respectively; and if said apparatus is acting as a positive or negative current source, clamping said inverting input to said first or second difference signal, respectively, and if the output voltage exceeds either said positive voltage reference or said negative voltage reference, dominantly clamping said inverting input to said third or fourth difference signal, respectively.

7. A method according to claim 6, wherein if said apparatus is acting as said positive or negative voltage source, said clamping to said third or fourth difference signal, respectively, is current limited, and if said apparatus is acting as said positive or negative current source, said clamping to said first or second difference signal, respectively, is current limited.

* * * * *

UNITED STATES PATENT AND TRADEMARK OFFICE

CERTIFICATE OF CORRECTION

PATENT NO. : 5,039,934

DATED : August 13, 1991

INVENTOR(S) : John G. Banaska

It is certified that error appears in the above-identified patent and that said Letters Patent is hereby corrected as shown below:

Column 5, line 29, "$-V_I^+/R$" should be ---$V_I^-/R$--.

Signed and Sealed this

Third Day of November, 1992

*Attest:*

DOUGLAS B. COMER

*Attesting Officer*

*Acting Commissioner of Patents and Trademarks*